United States Patent [19]

Jullien

[11] 4,255,010

[45] Mar. 10, 1981

[54] LAMP SOCKET ASSEMBLY

[75] Inventor: Eugenie L. Jullien, Paris, France

[73] Assignee: Compagnie Internationale d'et de Realisations Electrotechniques, Paris, France

[21] Appl. No.: 49,303

[22] Filed: Jun. 18, 1979

[30] Foreign Application Priority Data

Mar. 13, 1978 [FR] France ..... 78 07138

[51] Int. Cl.[3] ..... H01R 17/04

[52] U.S. Cl. ..... 339/176 L; 339/91 L; 339/212; 339/217 S

[58] Field of Search ..... 339/75 R, 75 T, 74 L, 339/217 S, 91 L, 76–79, 176 L, 212

[56] References Cited

U.S. PATENT DOCUMENTS

| | | | |
|---|---|---|---|
| 1,985,459 | 12/1934 | Pratt | 339/75 T |
| 2,192,943 | 3/1940 | Sumner | 339/176 L |
| 2,462,530 | 2/1949 | Miller | 339/91 L |
| 2,848,701 | 8/1958 | McKee et al. | 339/91 L |
| 2,912,665 | 11/1959 | Irwin | 339/91 L |
| 3,200,355 | 8/1965 | Dahlen | 339/217 S |
| 3,571,784 | 3/1971 | Naus et al. | 339/217 S |
| 4,010,993 | 3/1977 | Hohenberger et al. | 339/217 S |

*Primary Examiner*—John McQuade

[57] ABSTRACT

A lamp socket provided with resilient pawls spaced about its periphery, and a resilient member acting against the central stud. The pawls retract with the passage of a lamp into the socket and once the lamp is inserted, the pawls and resilient member apply pressure against the sides and bottom of the base to hold the lamp in place. Electrical contact is established through the pawls on the periphery of the lamp base and by the resilient member acting on the central stud.

6 Claims, 3 Drawing Figures

LAMP SOCKET ASSEMBLY

BACKGROUND OF THE INVENTION

The present invention relates to holding devices for miniature lamps and the like and in particular to a socket and lamp combination.

Lamps particularly small or miniature lamps are used extensively in such applications as control panels, indicating devices sensing devices and etc. Sometimes the lamps are used in conjunction with or integrated with a control member such as the switch or the like. In general, these control devices utilize a plurality of lamps arranged in predetermined patterns representing particular functions and/or operations of the various equipment, control circuits and the like with which they are associated. Not infrequently control panels even for very simple apparatus have an extremely large number of such lamps.

In order to reduce the size of such control panels, they are equiped with lamps of very small or even miniature size. Such devices comprise a bulb mounted on a base having on its posterior face a central contact stud and on the peripheral rim a flange which forms the second contact element of the bulb. The lamps are installed and removed from the control panel through its rear face, requiring the housing, on which the control panel is mounted, to have permanently available to it, access space from the rear. Sometimes, the removal of the socket from its mounting is required in order to gain access for the installation and removal of the lamp.

This latter problem is further complicated when the lamps are integrated with auxillary devices, for example, with push buttons controlling certain functions of the associated equipment.

It is an object of present invention to overcome the difficulties and disadvantages of the prior art devices and to provide a socket in combination with a lamp, which permits an easy and simple installation and removal of the lamp from the front of the panel without disturbance to any other portion of the control system.

SUMMARY OF THE INVENTION

According to the present invention a lamp socket is provided with resilient pawls spaced about its periphery, and a resilient member acting against the central stud. The pawls retract with a passage of the lamp into the socket and once the lamp is inserted, the pawls and the resilient member apply pressure against the sides and bottom of the base to hold the lamp in place. Electrical contact is established through the pawls on the periphery of the lamp base and by the resilient member acting on the central stud.

In conjunction with the socket, a device is provided to retract the pawls and remove the lamp from the socket simultaneously. A particular form of device for removal of the lamp comprises an elastic pincer, having a cylindrical cross-section formed by a number of axially extending jaws which move between the lamp and the resilient pawls. The jaws apply a mild friction or pincer action on the face of the lamp while simultaneously moving the pawls aside thus permitting the withdrawal of the lamp from the socket carried by the pincer.

The resilient member acting on the central stud on the posterior face of the base is preferably formed by a helical or conical compression spring which serves simultaneously as a conductor. The pressure exerted on the base may be enhanced by the use of an auxilliary spring such as a helical ring which acts on the posterior face of the base concentric with the central stud. The latter construction improves the axial steadiness of the lamp in the socket.

Preferably the socket is metal and the pawls are formed by cutting the metal so that three regularly distributed fingers are formed, integrally connected at one end of the socket. This triangular arrangement acts to hold the lamp and make better electrical contact with optimal pressure between the lamp base and the socket itself.

In accordance with the present invention the lamp socket permits installation and removal of the lamp through the front wall of the control panel thus simplifying its construction and providing great facility for maintenance.

Full details of the present invention are set forth in the following description, and are shown in the accompanying drawings.

DESCRIPTION OF THE INVENTION

Figure 1:
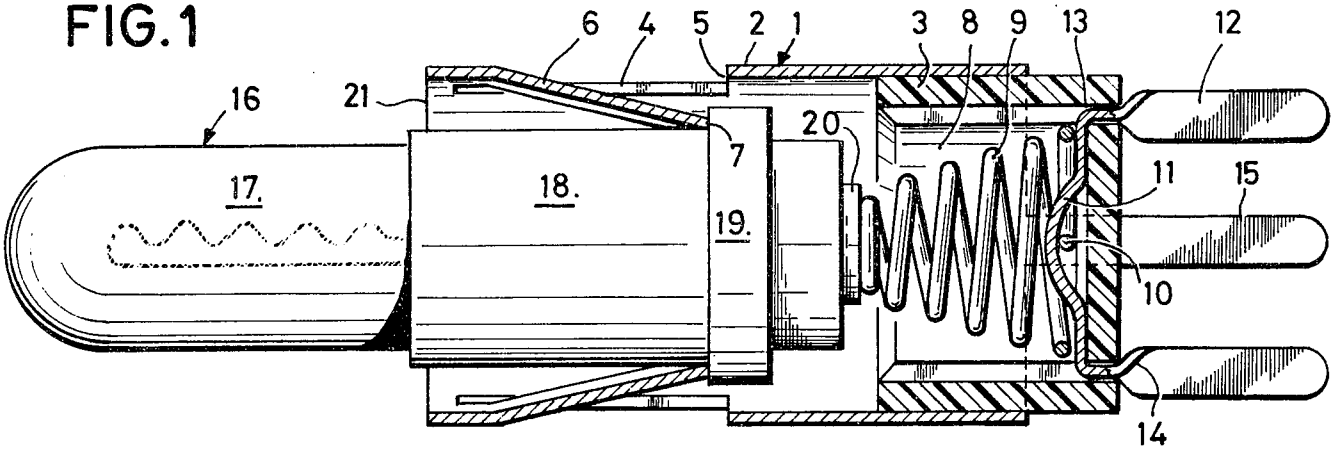
FIG. 1 is an axial section of the socket, showing the lamp inserted therein.

As seen in FIG. 1 the lamp of the present invention, generally depicted by the numeral 1, comprises a cylindrical sleeve 2 of an electrically conductive material, preferably of a ferrous metal, closed at its posterior end or bottom by a cup shaped member 3. The bottom member 3 extends within the sleeve, in force fit, and it is secured in place therewith by any suitable means such as screws, weldments, interengaging prong members, swedging or the like.

The wall of the sleeve 2, adjacent its forward end, is cut along axial lines 4 and transverse lines 5 to produce a plurality of fingers or pawls 6. The pawls 6 are integral with the sleeve at their forward end and at that end are bent inwardly toward the central axis of the sleeve terminating in a free end 7. Preferably the pawls 6 are set uniformly about the circumfrance of the sleeve 2 and preferably are three in number. Mounted within the bottom member 3 is a cup 8 made of conductive material such as ferrous metal.

Within the cup 8 is a helical, conical compression spring 9, the larger turn of which rests upon the bottom of the cup while the smaller turn extends upwardly through the main section of the sleeve. The larger or bottom turn of the spring 9 is provided with a diametric end 10 which is imprisoned under a U-shaped staple 11, having a pair of arms 12 which extends through openings 13 in the posterior wall of the bottom member. The arms 12 are twisted as at 14 so as to be flush with the posterior wall to thereby exert a pressure, via staple 11 onto the diametric end 10. The arms 12 provide the exterior electrical terminals and contact means for the lamp socket. A similar arm 15 is formed integral or unitary with extending from the sleeve 2. Since the sleeve 2 and the arm 15 are on the exterior surface of the bottom member 3, they are insulated from the contacts 12 and thus from the helical compression spring 9. The terminal 15 forms with the sleeve the second exterior contact. The arms 12 and 15 maybe used as a plug or pins for connection to its own receiving socket or for the electrical connection to a line source by tying the line conductor or soldering the line conductor directly thereto.

As further seen in FIG. 1, a lamp generally depicted by the numeral 16, comprises a transparent bulb 17 in which a filament is located extending into a metal base 18. Preferably the bulb 17 has a cross-sectional diameter less than that of the corresponding diameter of the base 18. Formed about the periphery of the base 18 is a radially extending flange 19, while from the posterior end of the base 18 there extends a central stud 20. The stud is escapsulated and separated from the base 19 by a suitable insulation and is formed in a manner so as to provide the first contact for the lamp. The flange 19 may be integral with the base or unitary with it and of metal material so as to provide the second contact for the lamp. Flange 19 extends radially a sufficient distance so that the free ends 7 of the resilient pawls will find a suitable shoulder facing the forward end of the lamp for seating.

Installation of the lamp 16 is achieved by pushing the lamp base first inwardly of the sleeve 2 so that the flange 19 rides along the interior surface of the pawls 6, pushing these pawls radially aside until the flange 19 passes the free end 7. When this occurs, the pawls 6 spring inwardly toward the central axis and then snap onto the shoulder formed by the flange 19, in the position shown in FIG. 1. Simultaneously, the central stud 20 bears resiliently against and compresses the spring 9. Because of the uniform disposition of the pawls 6, and the free ends 7 against the shoulder of the flange 19, and the counteracting force of the compression spring 9, the lamp is held securely in place.

The filament of the lamp is electrically connected between the stud 20 and the base 18 and is fed from strips 12 and 15 connected respectively thereto. In the preferred form wherein the pawls 6 are arranged triangularly, level support of the lamp without excess pressure, and having optimum contact pressure between socket and the base 18 are provided. In this connection it is to be noted that contact with the base is made not only through the free ends 7 but also through the adjacent flat surfaces of the pawls which bear against the cylindrical surface of the base 18. Thus, the flange need not be made of conductive material if desired.

Figure 3:
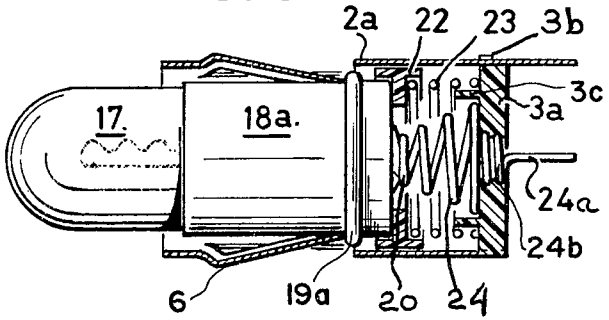

Should it be desired to improve the qualitites of stability and holding, and electrical contact, the arrangement shown in FIG. 3 may be employed. As seen in FIG. 3 the sleeve 2a forming the socket is similar to that shown on FIG. 1. However, the bottom or closure member 3a is slightly different in that it is not formed cup shape but as a planar disc force fit or otherwise secured by suitable means such as rivet 3b at the posterior end of the sleeve. The compression spring 24 is itself formed with a screw-shaped end 24b inbedded within the bottom plate 3a and terminating in a contract arm 24a extending axially from the posterior end.

Mounted within the sleeve 2a is a ring-shaped member 22 having a central opening which member is mounted so as to be slideable with respect to the inner surface of the sleeve 2a. Mounted about the conical compression spring is a helical cylindrical spring 23 which abuts at one end against the bottom wall 3a and at its other end against the slideable ring 22. The ring 22 has an inner diameter small enough so that the ring abuts squarely against the peripheral edge of the posterior base of the base 18a while large enough to permit the compression spring 24 to move through it against the central contact stud 20. The inner face of the bottom member 3a is provided with an axially extending or cylindrical extension 3c which acts to guide the auxilliary spring 23.

The lamp itself is similar to that of FIG. 1 except that the base 18a is provided with a flange 19a which is beaded or rounded in its exterior surface and is somewhat narrower than that shown in FIG. 1. In any event, it does provide a suitable seating surface or shoulder for engagement of pawls 6. The arrangement of FIG. 3 in providing the added auxiliary spring and has the advantage in that the compression spring employed as the contact for the central stud need not function wholly in the dual role of compression and contacts spring.

Figure 2:
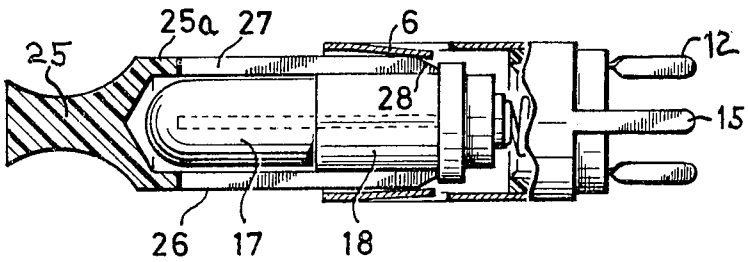
FIG. 2 is a view partially in section of the lamp and socket combination of FIG. 1 in conjunction with the removing tool, and, FIG. 3 is a view similar to FIG. 1, in smaller scale showing another embodiment of the socket.

To permit the easy removal of the lamp once the same is inserted in either the embodiment of FIG. 1 or the embodiment of FIG. 3, a removing tool generally depicted by the numeral 25 is shown in FIG. 2. This removing tool comprises a handle 25a comprising a plurality of elongated jaw members 26, separated by slots 27, arranged in a generally cylindrical manner. The forward end of each of the jaw members 26 is beveled at 28. The inner diameter of the cylinder defined by the jaw members 26 is somewhat larger than that of the base 18 (18a) so as to permit it to slide thereover yet be resiliently in contact therewith due to the pincer action effected by the cantilevered nature of the jaws 26 and the resilient nature of the handle 25a. Thus, as the removing tool is inserted into the socket about the bulb 16 its forward ends 28 ride upon and engage with the pawls 6 pushing the pawls 6 radially outward beyond the extent of the flange 19, (19a), thus freeing the pawls from their contact with the peripheral surface of the base 18 (18a) or the flange 19 (19a). Slight compression on the jaw members 26 by the user will thus cause the lamp 16a to be carried by the pincer action of the jaws 26 outwardly of the socket and be easily removed.

Preferably the removing tool is made of a suitable plastic and non-conductive material which has a resilient characteristic. This provides very fast means for removing the lamp from the front face of the panel in which it is used obviating the need for access to the posterior face to the panel or shutdown of the central system. Removal is accomplished with a minimum of difficulty and without any risk or disturbance to the structure of the socket, its electrical connections, or with regard to any of the other sockets or their lamps on the panel in question.

Various modifications and embodiments have been shown in the foregoing disclosure. Other embodiments changes and modifications will be apparent to those skilled in the present art. Accordingly, it is intended that the present disclosure not be limiting the scope of the invention.

What is claimed is:

1. A socket assembly for a lamp having a cylindrical base provided with a first electrical contact at the end thereof and with a second electrical contact in the form of a continuous radially extending annular flange, said socket assembly comprising a metallic cylindrical sleeve having an inner diameter larger than the outer diameter of said base so that said base is spaced from said cylindrical sleeve, said cylindrical sleeve being open at one end for axial insertion of the base of said lamp, three tongues cut from said cylindrical sleeve and bent to extend resiliently from a point adjacent said one end inwardly at an angle to the axis thereof, said tongues being spaced uniformly from each other and having free ends facing oppositely to the direction of insertion of the base of said lamp, said tongues being distendable outwardly on insertion of the base of said lamp into said cylindrical sleeve to permit said flange to pass the free ends of said tongues and spring means mounted at the other end of said cylindrical sleeve for making electrical connection with said first electrical contact comprising a sleeve acting on said first electrical contact in a direction opposite to the direction of insertion of the base to uniformly bias said base and cause the flange to electrically engage with the free ends of said tongues and to cause said lamp to center and firmly seat in said socket assembly with said base spaced from said cylindrical sleeve.

2. The socket assembly according to claim 1, including an insulator closure member fixed at the other end of said cylindrical sleeve, and wherein said spring means comprises a compression spring seated at one end against said closure member and at the other end against the base of said lamp.

3. The socket assembly according claim 1 including contact means integrally formed with said cylindrical sleeve and spring means respectively.

4. The socket according to claim 2, including contact means comprising prongs extending axially from the closure member in electrical connection with said cylindrical sleeve and said spring means.

5. The socket assembly according to claim 2 including an auxilliary spring means concentrically disposed about said compression spring being urged between the closure member and the base of the lamp.

6. The socket assembly according to claim 1, including means for removing said lamp from said socket assembly comprising a body having a plurality of fingers extending outwardly therefrom in a generally cylindrical arrangement adapted to fit over said lamp between said cylindrical sleeve and base into engagement with said tongues, said fingers being resiliently biased radially inward to grasp said lamp and permit extraction thereof.

* * * * *